US005266939A

United States Patent [19]

Shibasaki et al.

[11] Patent Number: 5,266,939

[45] Date of Patent: Nov. 30, 1993

[54] MEMORY DATA SYNTHESIZER

[75] Inventors: Takeshi Shibasaki; Hiroshi Kobayashi, both of Itami, Japan

[73] Assignee: Mitsubishi Denki Kabushiki Kaisha, Tokyo, Japan

[21] Appl. No.: 803,902

[22] Filed: Dec. 9, 1991

Related U.S. Application Data

[63] Continuation-in-part of Ser. No. 352,405, May 16, 1989, abandoned.

[30] Foreign Application Priority Data

Jan. 18, 1989 [JP] Japan ..... 1-9013

[51] Int. Cl.[5] ..... G09G 3/00

[52] U.S. Cl. ..... 345/195; 345/143

[58] Field of Search ..... 340/721, 734, 735, 750, 340/790, 799, 545, 548; 358/22

[56] References Cited

U.S. PATENT DOCUMENTS

| | | | |
|---|---|---|---|
| 4,079,458 | 3/1978 | Rider et al. | 340/750 |
| 4,443,794 | 4/1984 | Sakurai | 340/735 |
| 4,584,573 | 4/1986 | Ito | 340/734 |
| 4,600,920 | 7/1986 | Makita | 340/790 |
| 4,740,783 | 4/1988 | Lawrence et al. | 340/790 |
| 4,816,809 | 3/1989 | Kim | 340/584 |
| 4,835,520 | 5/1989 | Aiello | 340/545 |
| 4,937,565 | 6/1990 | Suwannukul | 340/750 |
| 4,992,781 | 2/1991 | Iwasaki et al. | 358/22 |

FOREIGN PATENT DOCUMENTS

| | | |
|---|---|---|
| 0206695 | 12/1986 | European Pat. Off. . |
| 0136819 | 5/1987 | European Pat. Off. . |
| 8906030 | 6/1989 | World Int. Prop. O. . |

OTHER PUBLICATIONS

IBM Technical Disclosure Bulletin; vol. 24, No. 212, May 1982, pp. 6250–6251; Generation of Characters; P. A. Beaven and C. Williams.

*Primary Examiner*—Ulysses Weldon
*Assistant Examiner*—M. Fatahiyar
*Attorney, Agent, or Firm*—Oblon, Spivak, McClelland, Maier & Neustadt

[57] ABSTRACT

A ROM part (24) of a charactor ROM (21) stores a plurality of font data. A display data RAM (9) simultaneously supplies a plurality of address signals to the charactor ROM (21) which is provided with a plurality of address decoders (25, 26). Respective address signals are decoded by the corresponding address decoders (25, 26), so that the font data corresponding to the address signals are read on the common bit lines ($BL_1$–$BL_l$). Thus, the font data as read are synthesized on the common bit lines ($BL_1$–$BL_l$) as a logical sum.

6 Claims, 9 Drawing Sheets

FONT 1

+

FONT 2

=

SYNTHETIC FONT

MEMORY DATA SYNTHESIZER

This application is a continuation of application Ser. No. 07/352,405, filed on May 16, 1989, now abandoned.

BACKGROUND OF THE INVENTION

1. Field of the Invention

The present invention relates to a memory data synthesizer which is applied to a display controller etc. for displaying arbitrary characters or patterns on the screen of a display unit.

2. Description of the Background Art

In general, characters, patterns or the like are displayed on the screen of a television to indicate channels or various operating states. FIG. 1 is a block diagram showing a conventional display controller of this type.

Referring to FIG. 1, horizontal and vertical synchronizing signals are inputted through a synchronizing signal input circuit 1, and supplied to an oscillation circuit 2 and an H-counter 3. The oscillation circuit 2 is reset for every horizontal synchronizing signal, to oscillate at a prescribed frequency. Oscillation output from the oscillation circuit 2 is supplied to a timing generator 4, which in turn produces timing signals required for operations of respective parts and outputs the same to the respective parts. The H-counter 3 is reset for every vertical synchronizing signal, to count the horizontal synchronizing signal. The count value of the H-counter 3 is supplied to a display position detecting circuit 5 for detecting display positions of characters or patterns to be displayed.

On the other hand, data and addresses for displaying desired characters or patterns are inputted through an input control circuit 6. An address control circuit 7 addresses a display control register 8 and a display data RAM 9 in accordance with the inputted addresses. The display control register 8 and the display data RAM 9 are arranged on the same address space with assignment of different addresses, whereby the inputted data are written in designated addresses of the display control register 8 and the display data RAM 9 through a data control circuit 10. Such data include character code data, color information data, display mode data, display position data and the like.

The display position detecting circuit 5 compares display position data stored in the display control register 8 with the count value of the H-counter 3, and supplies a coincidence signal to a read address control circuit 11 when the data coincide with the count value. Thus, the read address control circuit 11 is activated to address the display data RAM 9, thereby to start reading of previously written data. The display data RAM 9 supplies addresses corresponding to previously written character code data to a character ROM 12, so that corresponding fonts are read from the character ROM 12 responsively.

Each font is formed by pixels of $l \times m$ dots, as shown in FIG. 11, for example. Assuming that the character ROM 12 stores such fonts for n characters, its capacity corresponds to $l \times m \times n$ dots.

Data of the fonts read from the character ROM 12 are synthesized in a synthesizing circuit 13 at need. Output data from the synthesizing circuit 13 are converted from a parallel system into a serial system in a shift register 14, and supplied to a display control circuit 15. The display control circuit 15 receives color information data expressing character colors, background colors etc. from the display data RAM 9 and display mode data expressing character attribution etc. from the display control register 8 in addition to the font data from the shift register 14, to control the font data and the color information data in accordance with a display mode indicated by the display mode data. Thus, output signals of red, green and blue, a luminance control signal and the like are derived from the display control circuit 15, so that desired characters or patterns are displayed on the screen in accordance with these signals.

The character ROM 12 includes a read control circuit 16 and a ROM part 17 as shown in FIG. 2, for example. The read control circuit 16 is formed by an address decoder 18 and an output address circuit 19 as shown in FIG. 3, and the ROM part 17 is formed by m storage areas 17*a* to 17*m* as shown in FIG. 3, too. FIG. 4 shows the storage area 17*b*, for example, in detail. The remaining storage areas 17*a* and 17*c* to 17*m* are similar in structure. In this example, it is assumed that the character ROM 12 stores fonts of $l \times m$ dots for n characters.

Referring to FIG. 4, the storage area 17*b* includes $l \times n$ storage elements $M_{11}$ to $M_{ln}$, which are arranged in the form of a matrix. Each storage element is formed by an N-channel MOS transistor. The storage elements ($M_{11}$ to $M_{l1}$), ($M_{12}$ to $M_{l2}$), . . . , ($M_{1n}$ to $M_{ln}$) in respective columns have gates which are commonly connected to word lines $WL_1$, $WL_2$, . . . , $WL_n$, while the storage elements ($M_{11}$ to $M_{1n}$), ($M_{21}$ to $M_{2n}$), . . . , ($M_{l1}$ to $M_{ln}$) in respective rows have drains which are commonly guided to bit lines $BL_1$, $BL_2$, . . . , $BL_l$. Only a storage element of a bit having data as a font has a drain connected to a corresponding bit line BL. Referring to FIG. 4, the drain of the storage element $M_{31}$ is connected to the bit line $BL_3$. This corresponds to writing of font data in a chequered position shown in FIG. 11. The word lines $WL_1$ to $WL_n$ are commonly connected to all of the storage areas 17*a* to 17*m*.

The bit lines $BL_1$ to $BL_l$ are connected to a power source through P-channel MOS transistors $C_1$ to $C_l$ respectively. Data lines $DL_1$ to $DL_m$ for the respective storage areas 17*a* to 17*m* are connected to a power source through P-channel MOS transistors $E_1$ to $E_m$ respectively. At the beginning of every access, the timing generator 4 supplies a precharge signal PC to the gates of the P-channel MOS transistors $C_1$ to $C_l$ and $E_1$ to $E_m$ for a prescribed period, whereby the transistors $C_1$ to $C_l$ and $E_1$ to $E_m$ responsively conduct to precharge the bit lines $BL_1$ to $BL_l$ and the data lines $DL_1$ to $DL_m$.

After such precharging, the address decoder 18 supplies one of address decode signals $A_1$ to $A_n$ to a corresponding word line WL in response to an address from the display data RAM 9. Assuming that the address decode signal $A_1$ is supplied to the word line $WL_1$, for example, all of storage elements connected with the word line $WL_1$ conduct. In the storage area 17*b* shown in FIG. 4, the storage elements $M_{11}$ to $M_{l1}$ conduct so that the charge precharged in the bit line $BL_3$ is extracted through the storage element $M_{31}$ which is connected to the bit line $BL_3$.

The bit lines $BL_1$ to $BL_l$ are commonly connected to the data line $DL_2$ of the storage area 17*b* through output gate transistors $G_1$ to $G_l$ which are formed by N-channel MOS transistors. The gates of the output gate transistors $G_1$ to $G_l$ are connected to control lines $CL_1$ to $CL_l$ respectively. The control lines $CL_1$ to $CL_l$ are commonly connected with all of the storage areas 17*a* to 17*m*. The output address circuit 19 sequentially supplies signals $B_1$ to $B_l$ to the control lines $CL_1$ to $CL_l$ in response to a timing signal from the timing generator 4. In response to this, the output gate transistors $G_1$ to $G_l$ sequentially conduct in the storage area 17*b* shown in FIG. 4, so that information in the bit lines $BL_1$ to $BL_l$ is sequentially read on the data line $DL_2$. Similar operation is simultaneously performed with respect to the remaining storage areas 17*a* and 17*c* to 17*m*, whereby m-bit data are read in parallel from the storage areas 17*a* to 17*m* on the data line $DL_1$ to $DL_m$. At the timing when a signal $B_3$ is supplied to the control line $CL_3$, for example, data on third bit lines $BL_3$ of the storage areas 17*a* to 17*m* are read in parallel on the data lines $DL_1$ to $DL_m$. This corresponds to reading of m data on the third line in FIG. 11. Thus, in the conventional display controller of the above structure, one font is accessed upon every addressing.

It may be required for a display controller to synthesize a font 1 (FIG. 12A) and another font 2 (FIG. 12B) which are stored in the character ROM 12 with each other, in order to display a synthetic font shown in FIG. 12C on the screen in case of cursor display or underline display, for example. FIG. 5 is a timing chart of data reading in such case. Following a precharge signal PC, the display data RAM 9 supplies an address 1 to the address decoder 18, so that data on the corresponding font 1 is read from the ROM part 17 in response. Again following a precharge signal PC, the display data RAM 9 supplies an address 2 to the address decoder 18, so that data on the corresponding font 2 is read from the ROM part 17 in response. The data of the fonts 1 and 2 are supplied in parallel to the synthesizing circuit 13, which is formed by m RS flip-flops, which are arranged in parallel with each other, for example. The RS flip-flops are first set by the data of the font 1 and then set by the data of the font 2. The data of the fonts 1 and 2 are thus synthesized and latched. Thus, the synthetic font shown in FIG. 12C is produced.

In order to obtain a synthetic font in the conventional display controller, thus, it is necessary to access the character ROM 12 a plurality of times to synthesize respective outputs by the separately provided synthesizing circuit 13, thereby to obtain the logical sum and latch the same. In the display controller, on the other hand, characters or patterns must be outputted to a cathode ray tube or the like from the display control circuit 15, in response to scan timing of the television. Therefore, the data must be read from the character ROM 12 in real time with scanning, and hence high-speed access is required. However, it has been extremely difficult to access the character ROM 12 a plurality of times and synthesize the data read from the same in real time with scanning of the television.

It is wasteful and inefficient in circuit structure to provide a plurality of character ROMs 12 in order to obtain the synthetic output. It is also wasteful and inefficient in circuit structure to store synthetic fonts such as that shown in FIG. 12C in addition to normal fonts such as those shown in FIGS. 12A and 12B in the character ROM 12.

SUMMARY OF THE INVENTION

A memory data synthesizer according to the present invention comprises address signal providing means for simultaneously providing a plurality of address signals, a plurality of identification signal deriving means for receiving the plurality of address signals, respectively, to derive identification signals corresponding to the respective address signals as received, and memory means having an output line, for storing a plurality of prescribed data with assignment of different addresses and simultaneously receiving the identification signals from the plurality of identification signal deriving means to simultaneously read the corresponding data on the output line so that the data as read are synthesized on the output line as a logical sum.

According to the present invention, a plurality of data stored in memory means are accessed at the same timing to automatically generate synthetic data, which are the logical sum of the data, in the memory means. Thus, synthetic fonts can be efficiently produced when a memory data synthesizer according to the present invention is applied to a character ROM for a display controller, for example. Consequently, various display contents such as cursor display and underline display can be easily brought on the screen of a television or the like. Further, it is sufficient to provide only a plurality of identification signal deriving means, and hence the chip size can be minimized in integration of the inventive memory data synthesizer.

Accordingly, an object of the present invention is to provide a memory data synthesizer which can efficiently produce synthetic fonts in application to a display controller.

These and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
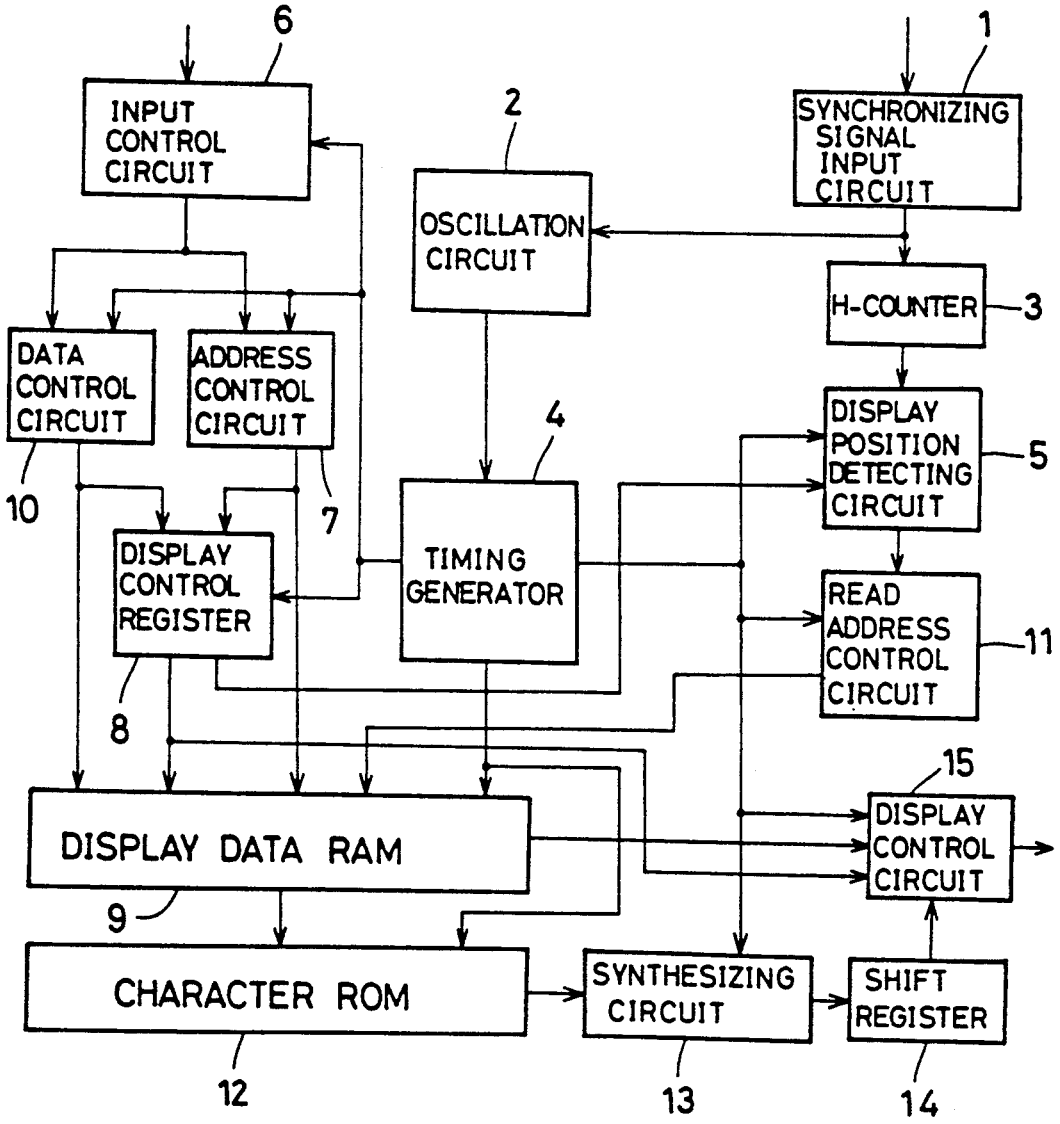
FIG. 1 (BACKGROUND ART)
FIG. 1 is a block diagram showing a conventional display controller.
Figure 2:
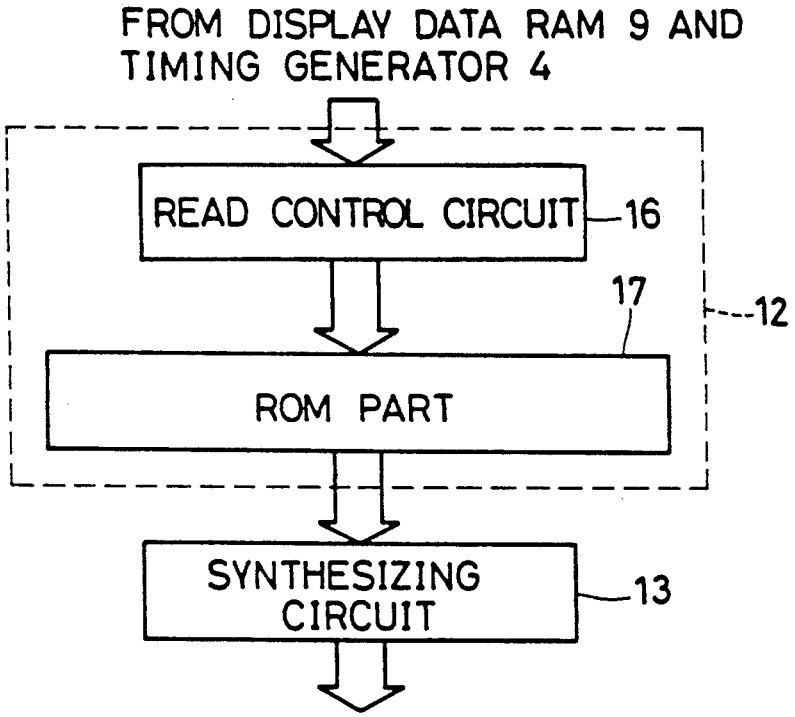
FIG. 2 (BACKGROUND ART)
FIG. 2 is a block diagram schematically showing the structure of a conventional character ROM.
Figure 5:
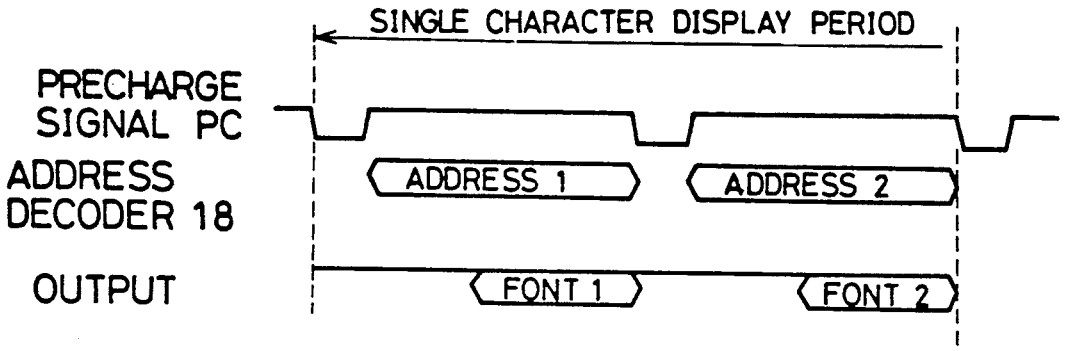
FIG. 5 (BACKGROUND ART)
FIG. 5 is a timing chart showing timing for synthesizing font data in a conventional display controller.
Figure 3:
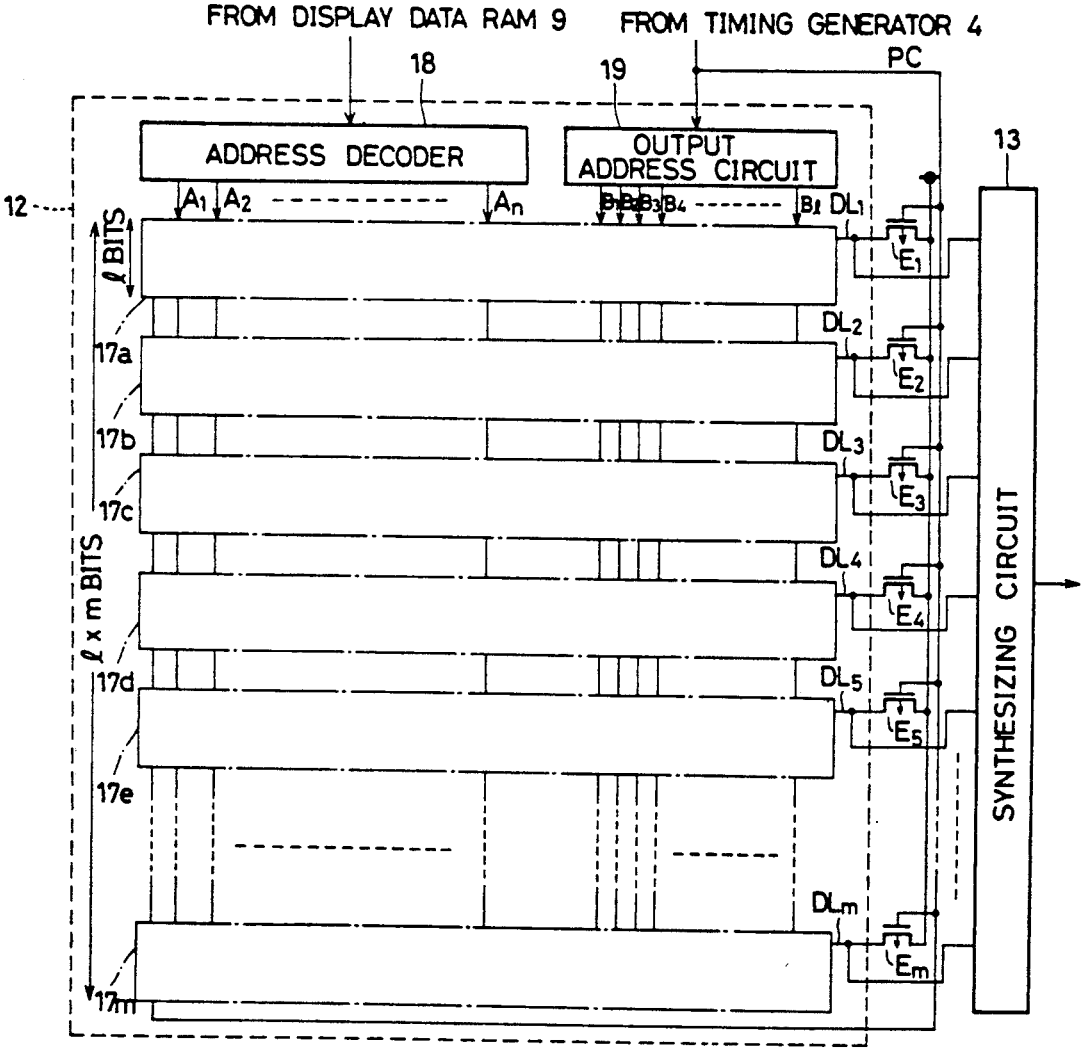
FIG. 3 (BACKGROUND ART)
FIG. 3 is a circuit diagram showing the structure of the conventional character ROM in detail.
Figure 6:
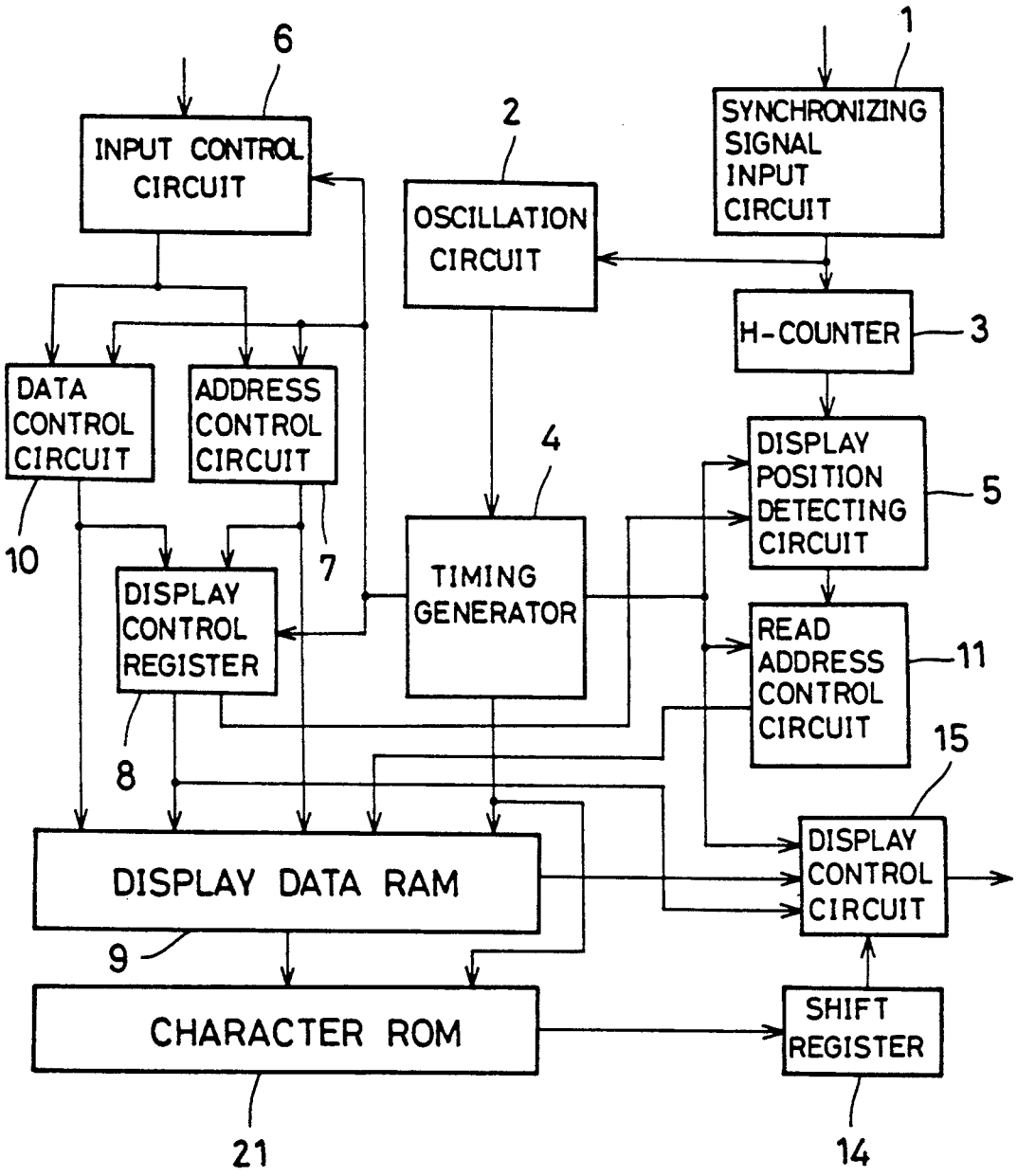
FIG. 6 is a block diagram showing an embodiment of a display controller to which a memory data synthesizer according to the present invention is applied.

FIG. 6 is a block diagram showing an embodiment of a display controller, to which a memory data synthesizer according to the present invention is applied. This embodiment is different from the conventional circuit shown in FIG. 1 in that a character ROM 21 is differed in structure from the character ROM 12 shown in FIG. 1, to omit the synthesizing circuit 13 provided in the conventional apparatus. Other structure of this embodiment is similar to that shown in FIG. 1.

Figure 7:
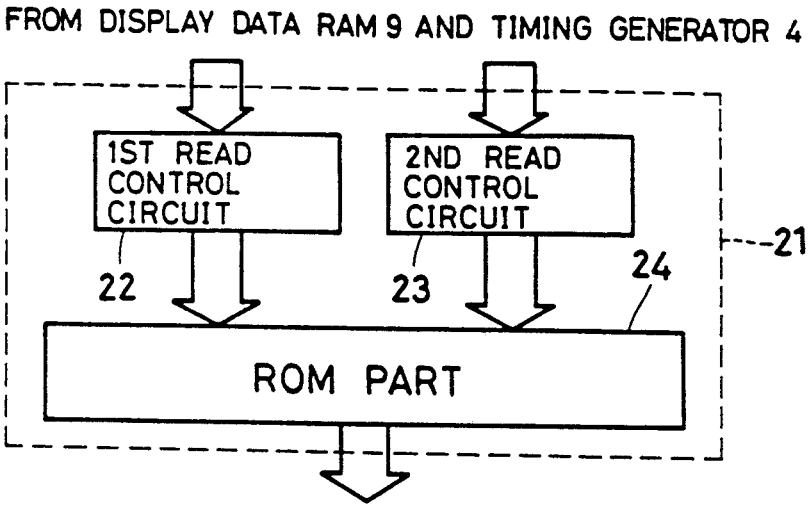
FIG. 7 is a block diagram schematically showing exemplary structure of a character ROM.
Figure 8:
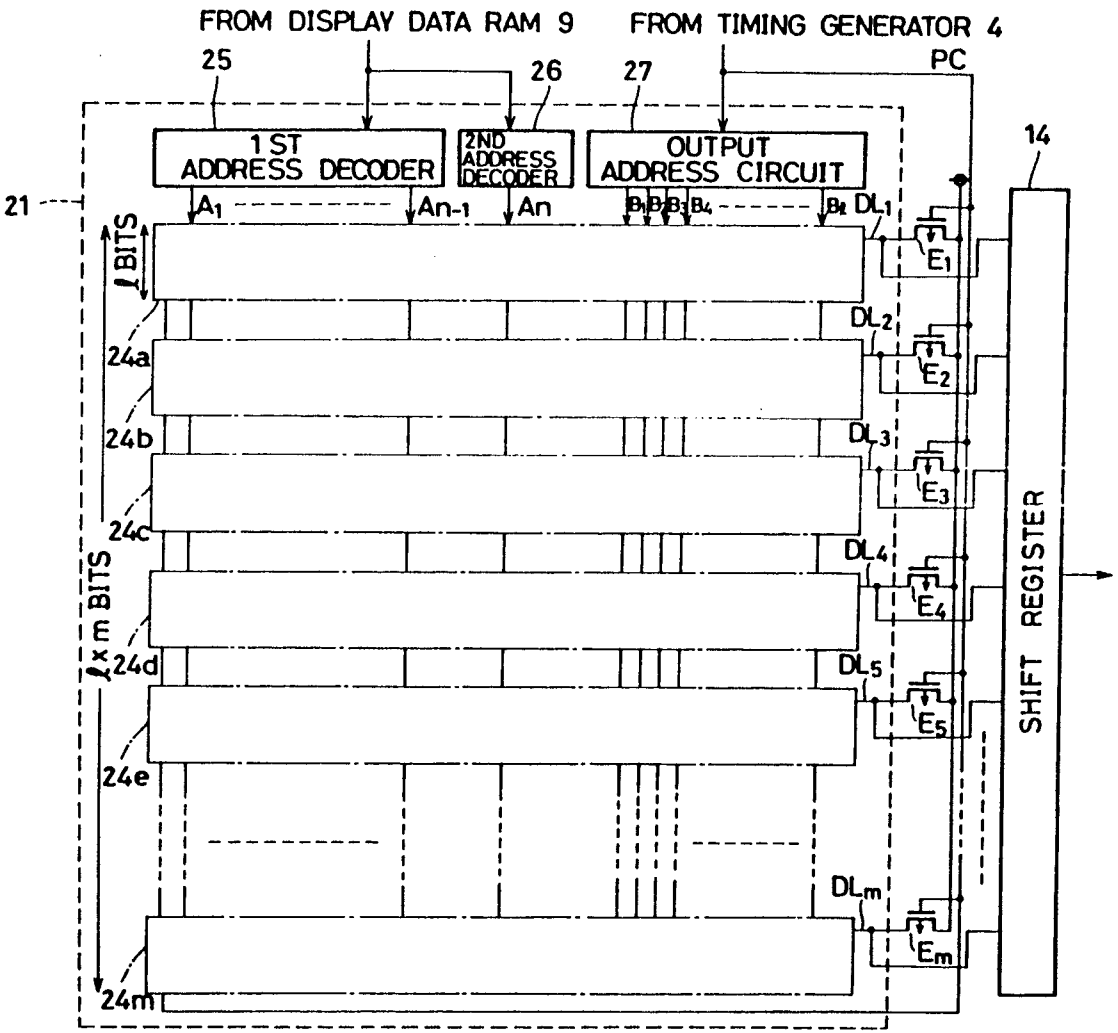
FIG. 8 is a circuit diagram showing the structure of the character ROM in detail.

FIG. 7 is a block diagram schematically showing exemplary structure of the character ROM 21, and FIG. 8 is a circuit diagram showing the structure of the character ROM 21 in further detail. As shown in FIG. 7, the character ROM 21 includes a first read control circuit 22, a second read control circuit 23 and a ROM part 24. The first read control circuit 22 corresponds to a first address decoder 25 and an output address circuit 27 shown in FIG. 8, and the second read control circuit 23 corresponds to a second address decoder 26 and the output address circuit 27 shown in FIG. 8. Namely, the output address circuit 27 is common to the first and second read control circuits 22 and 23. In this embodiment, the first address decoder 25 outputs one of address decode signals $A_1$ to $A_{n-1}$ in response to a prescribed address from a display data RAM 9, while the second address decoder 26 outputs an address decode signal $A_n$ in response to another prescribed address from the display data RAM 9.

Figure 4:
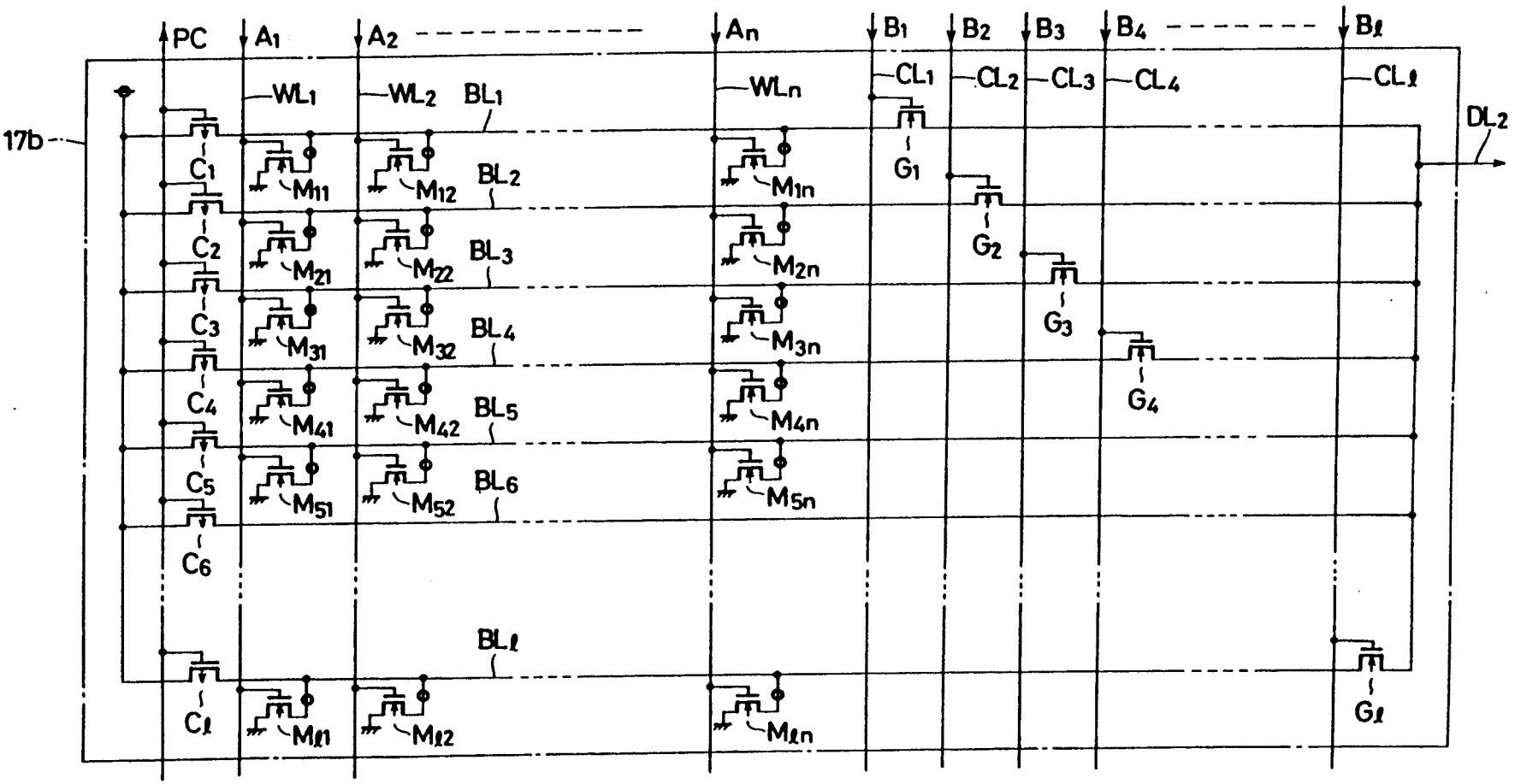
FIG. 4 (BACKGROUND ART)
FIG. 4 is a circuit diagram showing a storage area of the conventional character ROM in detail.
Figure 9:
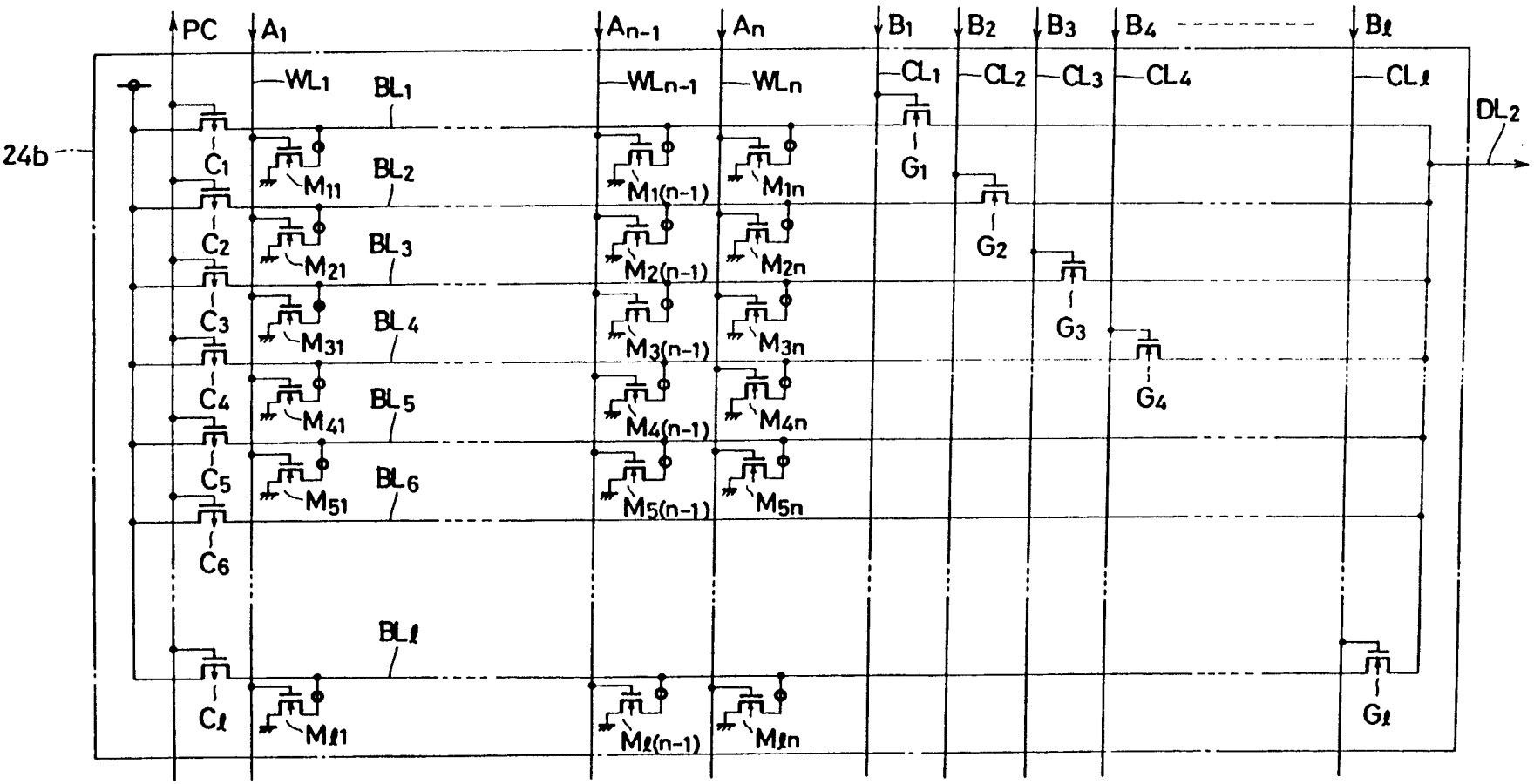
FIG. 9 is a circuit diagram showing a storage area of the character ROM in detail.

The ROM part 24 is formed by a storage areas 24*a* to 24*m*, as shown in FIG. 8. FIG. 9 is a circuit diagram showing the storage area 24*b*, for example, in detail. The remaining storage areas 24*a* and 24*c* to 24*m* are in similar structure. In this embodiment, the character ROM 21 stores fonts of $1 \times m$ dots for n characters, and one of specific $(n-1)$ characters corresponding to word lines $WL_1$ to $WL_{n-1}$ is read in response to the address decode signals $A_1$ to $A_{n-1}$ from the first address decoder 25, while a specific character corresponding to a word line $WL_n$ is read in response to the address decode signal $A_n$ from the second address decoder 26. The storage area 24*b* shown in FIG. 9 is similar in structure to the storage area 17*b* shown in FIG. 4, and hence redundant description is omitted.

In operation, a single font is read in a substantially similar manner to the aforementioned conventional case. Namely, at the beginning of access operation, a timing generator 4 supplies a precharge signal PC to gates of P-channel MOS transistors $C_1$ to $C_l$ and $E_1$ to $E_m$ for a prescribed period, whereby the transistors $C_1$ to $C_l$ and $E_1$ to $E_m$ responsively conduct to precharge bit lines $BL_1$ to $BL_l$ and data lines $DL_1$ to $DL_m$.

Then, the display data RAM 9 supplies addresses corresponding to desired characters or patterns to the first address decoder 25 or the second address decoder 26. In response to this, the first address decoder 25 or the second address decoder 26 supplies one of the address decode signals $A_1$ to $A_n$ to the corresponding word line WL. Assuming that the first address decoder 25 supplies the address decode signal $A_1$ to the word line $WL_1$, for example, all of storage elements connected with the word line $WL_1$ conduct. In the storage area 24*b* shown in FIG. 9, storage elements $M_{11}$ to $M_{l1}$ conduct so that a charge precharged in the bit line $BL_3$ is extracted through a storage element $M_{31}$, which is connected to the bit line $BL_3$.

Figure 11:
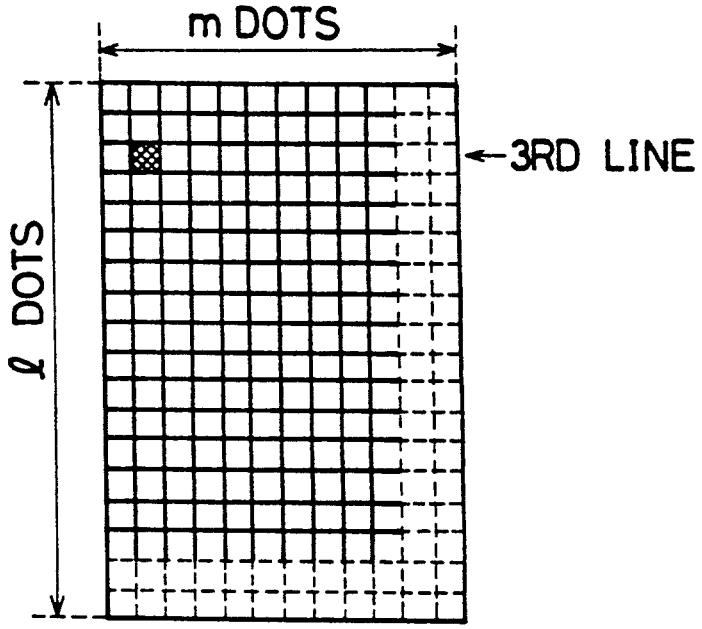
FIG. 11 is illustrative of dot structure of a font.

Then, in response to a timing signal from the timing generator 4, the output address circuit 27 sequentially supplies signals $B_1$ to $B_l$ to control lines $CL_1$ to $CL_l$. In response to this, output gate transistors $G_1$ to $G_l$ sequentially conduct in the storage area 24*b* shown in FIG. 4, so that information in the bit lines $BL_1$ to $BL_l$ is sequentially read on the data line $DL_2$. Similar operation is simultaneously performed also with respect to the remaining storage areas 24*a* and 24*c* to 24*m*, whereby m-bit data are read in parallel from the storage areas 24*a* to 24*m* on the data lines $DL_1$ to $DL_m$. At the timing when the signal $B_3$ is supplied to the control line $CL_3$, for example, data on third bit lines $BL_3$ of the storage areas 24*a* to 24*m* are read in parallel on the data lines $DL_1$ to $DL_m$. This corresponds to reading of m data on the third line in FIG. 11.

Data of desired fonts thus read from the character ROM 21 are converted from parallel data into serial data in a shift register 14, and supplied to a display control circuit 15. The display control circuit 15 receives color information data expressing character colors, background colors and the like and display mode data expressing character modification etc. from a display control register 8 in addition to the font data from the shift register 14, to display-control the font data and the color information data in accordance with a display mode indicated by the display mode data. Thus, output signals of red, green and blue, a luminance control signal and the like are derived from the display control circuit 15, so that desired characters or patterns are displayed on the screen in accordance with these signals.

Figure 10:
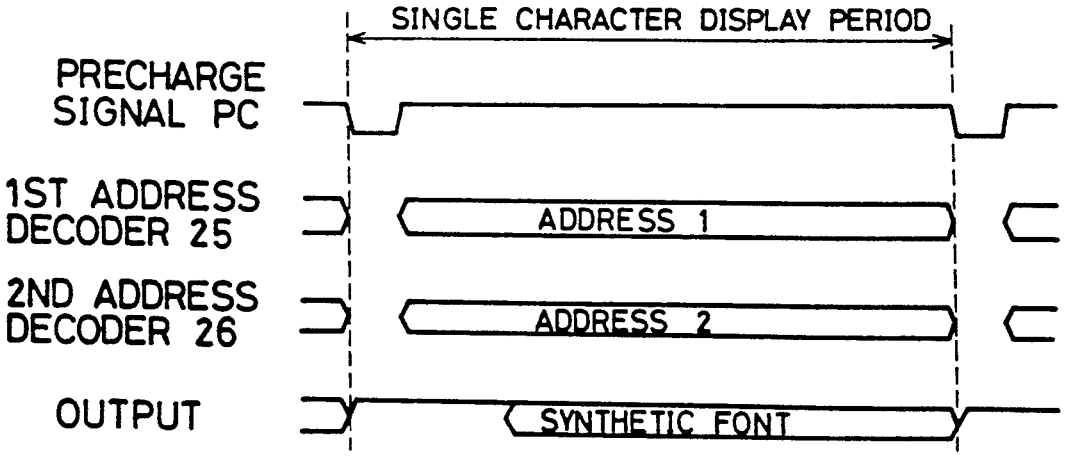
FIG. 10 is a timing chart showing timing for reading a synthetic font.
Figure 12A:
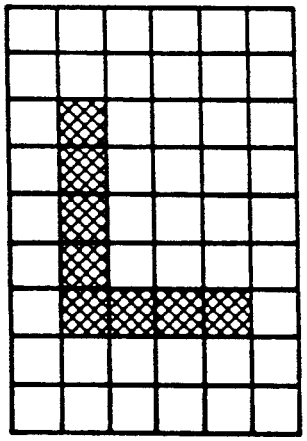
FIG. 12*a–c* is illustrative of synthesis of fonts.
Figure 12B:
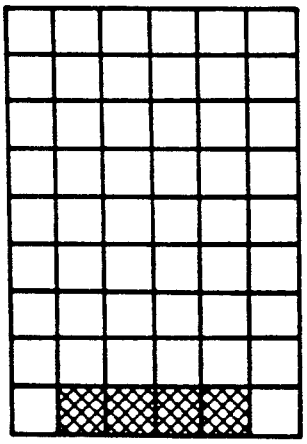

In this embodiment, the synthetic font shown in FIG. 12 is read through single access along a timing chart shown in FIG. 10. It is assumed here that the font 1 shown in FIG. 12A is stored in a storage element which is connected to the word line $WL_1$, and the font 2 shown in FIG. 12B is stored in a storage element which is connected to the word line $WL_n$.

Referring to FIG. 6, character code data corresponding to the fonts 1 and 2 are inputted through an input control circuit 6. These character code data are written in designated areas of the display data RAM 9 through a data control circuit 10 in accordance with addressing by an address control circuit 7, similarly to the conventional apparatus shown in FIG. 1. In addition to the character code data, color information data, display mode data, display position data and the like are written in a display control register 8 or the display data RAM 9, similarly to the conventional apparatus shown in FIG. 1.

When scanning of the screen reaches a display position, a read address control circuit 11 is activated in response to a coincidence signal from a display position detecting circuit 5. After the bit lines $BL_1$ to $BL_l$ and the data lines $DL_1$ to $DL_m$ are precharged in the storage areas 24*a* to 24*m* in accordance with a precharge signal PC, the display data RAM 9 simultaneously supplies two addresses (addresses 1 and 2) corresponding to previously written two character code data in accordance with a command from the read address control circuit 11 to the character ROM 21, to address the same. The address 1 is supplied to the first address decoder 25 of the character ROM 21, while the address 2 is supplied to the second address decoder 26. The first address decoder 25 outputs the address decode signal $A_1$ in response to the address 1, while the second address decoder 26 outputs the address decode signal $A_n$ in response to the address 2.

All storage elements connected with the word lines $WL_1$ and $WL_n$ conduct in response to this. In the storage area 24*b* shown in FIG. 9, the storage elements $M_{11}$ to $M_{l1}$ and $M_{1n}$ to $M_{ln}$ conduct. Information responsively appearing on the bit lines $BL_1$ to $BL_l$ is the logical sum of information in the storage elements $M_{11}$ to $M_{l1}$ and that in the storage elements $M_{1n}$ to $M_{ln}$. In other words, the data of the font 1 and the data of the font 2 are synthesized on the bit lines $BL_1$ to $BL_l$. Similar operation is also simultaneously performed on the remaining storage areas 24a and 24c to 24m. Thus, data of the synthetic font are automatically generated in the character ROM 21.

Figure 12C:
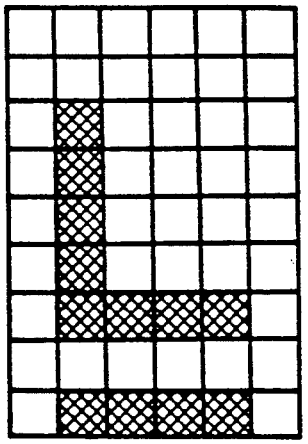

The data of the synthetic font are sequentially read from the character ROM 21 in a parallel system for every row (m bits) through the data lines $DL_1$ to $DL_m$ of the respective storage areas 24a to 24m by sequential conduction of the output gate transistors $G_1$ to $G_l$ in response to signals $B_1$ to $B_l$ which are sequentially supplied to the control lines $CL_1$ to $CL_l$ from the output address circuit 27. The parallel data are converted into serial data in the shift register 14, and supplied to the display control circuit 15. The display control circuit 15 performs operation similar to the above, whereby the synthetic font shown in FIG. 12C is displayed on the screen.

According to this embodiment, as hereinabove described, two address decoders are provided in the character ROM 21, which is structured to be capable of obtaining the logical sum of outputs, to access two fonts in the character ROM 21 at the same timing for automatically generating a synthetic font, which is the logical sum thereof, in the character ROM 21 and outputting the same. Thus, the synthesizing circuit 13 provided in the conventional apparatus shown in FIG. 1 can be omitted. The character ROM 21 can be provided with three or more address decoders. In this case, three or more fonts in the character ROM 21 can be accessed at the same timing, to automatically generate a synthetic font, which is the logical sum thereof. Further, the second address decoder 26 can decode a plurality of addresses dissimilarly to the above embodiment, to increase the number of combinations for synthesis.

Although the above description has been made on the case of applying the inventive memory data synthesizer to synthesis of font data in a character ROM of a display controller, the memory data synthesizer according to the present invention is also effective in the case of synthesizing ROM data for another object.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A memory data synthesizer comprising:

address signal providing means for simultaneously providing a plurality of address signals;

a plurality of identification signal deriving means for receiving said plurality of address signals, respectively, to derive a plurality of identification signals corresponding to respective said address signals;

a single memory means for storing a plurality of prescribed data, each of which defines a character or a pattern to be displayed on a screen of a display unit, with assignment of different addresses, said single memory means simultaneously receiving a plurality of said identification signals from said plurality of identification signal deriving means to simultaneously read from said memory means prescribed data corresponding to said plurality of received identification signals, said memory means comprising a common output line having a capacity for one of said prescribed data corresponding to a single said address for simultaneously outputting said prescribed data corresponding to said plurality of received identification signals such that data corresponding to respective identification signals is synthesized on said common output line as a logical sum of said prescribed data corresponding to said plurality of received identification signals.

2. A memory data synthesizer in accordance with claim 1, wherein said memory means comprises storage cells arranged in a form of a matrix of columns and rows, word lines provided for each set of said storage cells in respective said columns, for receiving said identification signals, and bit lines provided as said output line for each set of said storage cells in respective said rows.

3. A memory data synthesizer in accordance with claim 2, wherein each set of said storage cells in respective said columns stores a predetermined set of data.

4. A memory data synthesizer in accordance with claim 3, wherein each of said word lines is connected to one of said identification signal deriving means, each of said identification signal deriving means providing said identification signal to one of corresponding said word lines to read said predetermined set of data.

5. A memory data synthesizer in accordance with claim 1, wherein said identification signal deriving means includes an address decoder for decoding said address signal to output an address decode signal as said identification signal.

6. A memory data synthesizer in accordance with claim 3, wherein said predetermined set of data includes font data.

* * * * *